United States Patent [19]

Kamata

[11] 4,110,035

[45] Aug. 29, 1978

[54] CLEANING SYSTEM FOR AN ELECTROPHOTOGRAPHIC PRINTING MACHINE

[75] Inventor: Akira Kamata, Ebina, Japan

[73] Assignee: Rank Xerox, Ltd., London, England

[21] Appl. No.: 722,928

[22] Filed: Sep. 18, 1976

[30] Foreign Application Priority Data

Sep. 29, 1975 [JP] Japan ..... 50/131901[U]

[51] Int. Cl.[2] ..... G03G 21/00

[52] U.S. Cl. ..... 355/15; 15/256.51; 15/256.52; 118/652

[58] Field of Search ..... 355/15; 118/652; 15/1.5, 256.51, 256.52

[56] References Cited

U.S. PATENT DOCUMENTS

| | | | |
|---|---|---|---|
| 3,625,605 | 12/1971 | Schnall et al. | 355/15 |
| 3,667,840 | 6/1972 | Engel et al. | 355/15 X |
| 3,766,592 | 10/1973 | Suzuki | 15/256.51 |
| 3,975,096 | 8/1976 | Opravil | 355/15 |

*Primary Examiner*—Fred L. Braun

*Attorney, Agent, or Firm*—J. J. Ralabate; C. A. Green; H. Fleischer

[57] ABSTRACT

An apparatus in which a flexible web cleans contaminants from a member. A pressure member holds a portion of the flexible web in engagement with the member to remove the contaminants therefrom. The web is prevented from being entrained erroneously about the pressure member. The member being cleaned is preferably a photoconductive surface.

6 Claims, 3 Drawing Figures

CLEANING SYSTEM FOR AN ELECTROPHOTOGRAPHIC PRINTING MACHINE

BACKGROUND OF THE INVENTION

This invention relates generally to an electrophotographic printing machine, and more particularly concerns a cleaning apparatus employed therein.

In the process of electrophotographic printing, a photoconductive member is charged to sensitize the surface thereof. A light image of an original document is projected onto the charged photoconductive member selectively dissipating the charge thereon. This records a latent image of the original document on the photoconductive member. Heat settable particles, i.e., toner particles, are generally employed to develop the latent image. These particles are deposited on the photoconductive member and subsequently transferred therefrom to a sheet of support material. Heat is then applied to the toner particles to permanently affix them to the sheet of support material forming a copy of the original document.

Invariably, some residual toner particles remain adhering to the photoconductive surface after the transfer of the toner particles to the sheet of support material. These particles must be removed from the photoconductive surface prior to the initiation of the next successive cycle. This may be achieved by a cleaning web engaging the photoconductive surface to remove the residual toner particles therefrom. The unused cleaning web, stored on a supply spool, is advanced therefrom and maintained in engagement with the photoconductive surface by a pressure roller. A take up spool stores the unused or dirty cleaning web remote from the photoconductive surface. Hereinbefore, if the cleaning web slackened and folds developed therein, rotation of the pressure roller would cause the cleaning web to be entrained erroneously thereabout. This will jam the operation of the electrophotographic printing machine requiring correction of the problem by an operator prior to the resumation of copying.

Accordingly, it is a primary object of the present invention to improve the cleaning system employed in an electrophotographic printing machine by preventing the cleaning web from being entrained about the pressure roller.

SUMMARY OF THE INVENTION

Briefly stated, and in accordance with the present invention, there is provided an apparatus for cleaning contaminants from a member.

Pursuant to the features of the present invention, the apparatus includes a flexible web with a pressure member being arranged to hold the web in engagement with the member to remove contaminants therefrom. A supply station stores a supply of unused web, while a receiving station houses the used web. Means are provided for advancing the web from the supply station to the receiving station. Means prevent the web from being entrained about the pressure roller.

BRIEF DESCRIPTION OF THE DRAWINGS

Other objects and advantages of the present invention will become apparent upon reading the following detailed description and upon reference to the drawings, in which.

While the present invention will be hereinafter described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
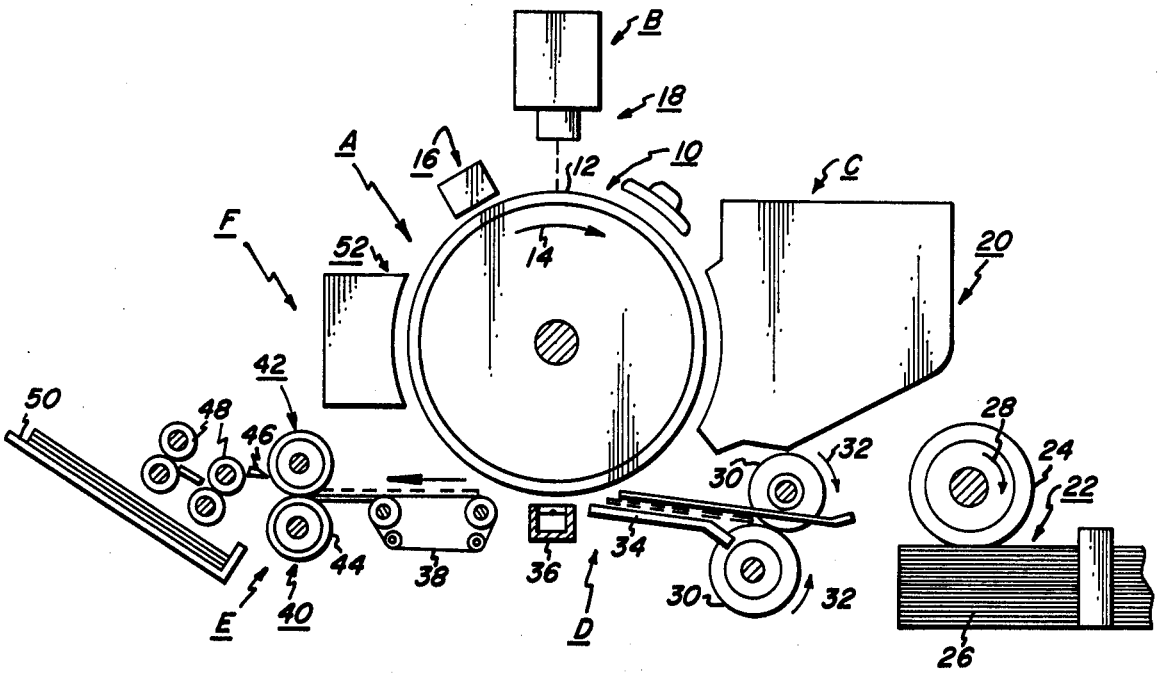
FIG. 1 is an elevational view depicting schematically an electrophotographic printing machine incorporating the features of the present invention therein.

For a general understanding of an electrophotographic printing machine in which the features of the present invention may be incorporated, reference is had to FIG. 1, which depicts schematically the various components thereof. Hereinafter, like reference numerals will be employed throughout to designate identical elements. Although the cleaning apparatus of the present invention is particularly well adapted for use in an electrophotographic printing machine, it should become evident from the following discussion that it is equally well suited for application in a wide variety of devices and is not necessarily limited to the particular embodiment shown herein.

Inasmuch as electrophotographic printing machines are well known, the various processing stations thereof will be represented in FIG. 1 by blocks. Each of these blocks will be described briefly hereinafter.

Referring now to FIG. 1, the electrophotographic printing machine utlizes a drum 10 having a photoconductive surface 12 entrained about and secured to the exterior circumferential surface thereof. As drum 10 rotates in the direction of arrow 14, it passes through the various processing stations disposed about the periphery thereof. A suitable photoconductive material may be a selenium alloy such as is described in U.S. Pat. No. 2,970,906 issued to Bixby in 1961.

Initially, a portion of photoconductive surface 12 rotates through charging station A. Charging station A includes a corona generating device, indicated generally by the reference numeral 16, positioned closely adjacent to photoconductive surface 12. Corona generating device 16 charges photoconductive surface 12 to a relatively high substantially uniform potential. A suitable corona generating device is described in U.S. Pat. No. 2,836,725 issued to Vyverberg in 1958.

Thereafter, as drum 10 continues to rotate in the direction of arrow 14, the charged portion of photoconductive surface 12 advances to exposure station B. Exposure station B includes an exposure mechanism, indicated generally by the reference numeral 18, having a stationary housing for supporting an original document thereon. The housing comprises a transparent platen having the original document disposed thereon. Lamps illuminate the original document. Scanning of the original document is achieved by oscillating a mirror in a timed relationship with the movement of drum 10, or, in lieu thereof, by moving the lamp and lens system to form a flowing light image thereof. The light image of the original document is projected onto the charged portion of photoconductive surface 12. In this manner, photoconductive surface 12 is irradiated selectively to dissipate the charge thereon and record an electrostatic latent image corresponding to the informational areas contained within the original document.

Drum 10 rotates the electrostatic latent image recorded on photoconductive surface 12 to development station C. At development station C, a developer unit 20 having a housing with a supply of developer mix contained therein renders the electrostatic latent image visible. The developer mix comprises carrier granules having toner particles adhering thereto. These carrier granules are generally formed from a magnetic material while the toner particles are usually a heat settable plastic. Preferably, developer unit 20 is a magnetic brush development system. In a system of this type, the developer mix is brought through a directional flux field forming a brush thereof. The brush of developer mix contacts the electrostatic latent image recorded on photoconductive surface 12. The latent image attracts electrostatically the toner particles from the carrier granules to form a toner powder image on photoconductive surface 12.

With continued reference to FIG. 1, a sheet of support material is advanced by sheet feeding apparatus 22 to transfer station D. Sheet feeding apparatus 22 includes a feed roll 24 contacting the uppermost surface of the stack of sheets of support material 26. Feed roll 24 rotates in the direction of arrow 28 to thereby advance the uppermost sheet from stack 26. Registration rollers 30, rotating in the direction of arrow 32, align and forward the advancing sheet of support material into chute 34. Chute 34 directs the advancing sheet of support material into contact with drum 10, in a timed relationship, so that the toner powder image developed thereon contacts the advancing sheet of support material at transfer station D.

At transfer station D, a corona generating device 36, sprays ions onto the side of the sheet of support material opposed from photoconductive surface 12. The toner powder image adhering to photoconductive surface 12 is then attracted therefrom to the surface of the sheet of support material in contact therewith. After transferring the toner powder image to the sheet of support material, endless belt conveyor 38 advances the sheet of support material to fixing station E.

Fixing station E includes a fuser assembly, indicated generally by the reference numeral 40. Fuser assembly 40 heats the powder image to permanently affix the toner particles to the sheet of support material. Preferably, fuser assembly 40 includes a heated fuser roll, shown generally at 42, and a backup roll, indicated generally by the reference numeral 44. The sheet of support material, with the toner powder image thereon, is interposed between fuser roll 42 and backup roll 44. The toner powder image contacts fuser roll 42. In this way, the toner powder image is permanently affixed to the sheet of support material. After the toner powder image is permanently affixed thereto, stripper blade 46 separates the sheet from fuser roll 42. Thereafter, the sheet of support material is advanced by a series of rollers 48 to catch tray 50 for subsequent removal therefrom by the machine operator.

Frequently, residual toner particles remain adhering to photoconductive surface 12 after the transfer of the toner powder image to the sheet of support material. These residual toner particles are removed from photoconductive surface 12 at cleaning station F. Cleaning station F includes a cleaning mechanism, generally indicated by the reference numeral 52. The cleaning mechanism will be described hereinafter in greater detail with reference to FIGS. 2 and 3. After cleaning, a discharge lamp floods photoconductive surface 12 to return it to the initial level prior to the recharging thereof at station A for the next successive imaging cycle.

It is believed that the foregoing description is sufficient for purposes of the present application to illustrate the general operation of an electrophotographic printing machine which exemplifies one type of printing machine employing the features of the present invention therein.

Figure 2:
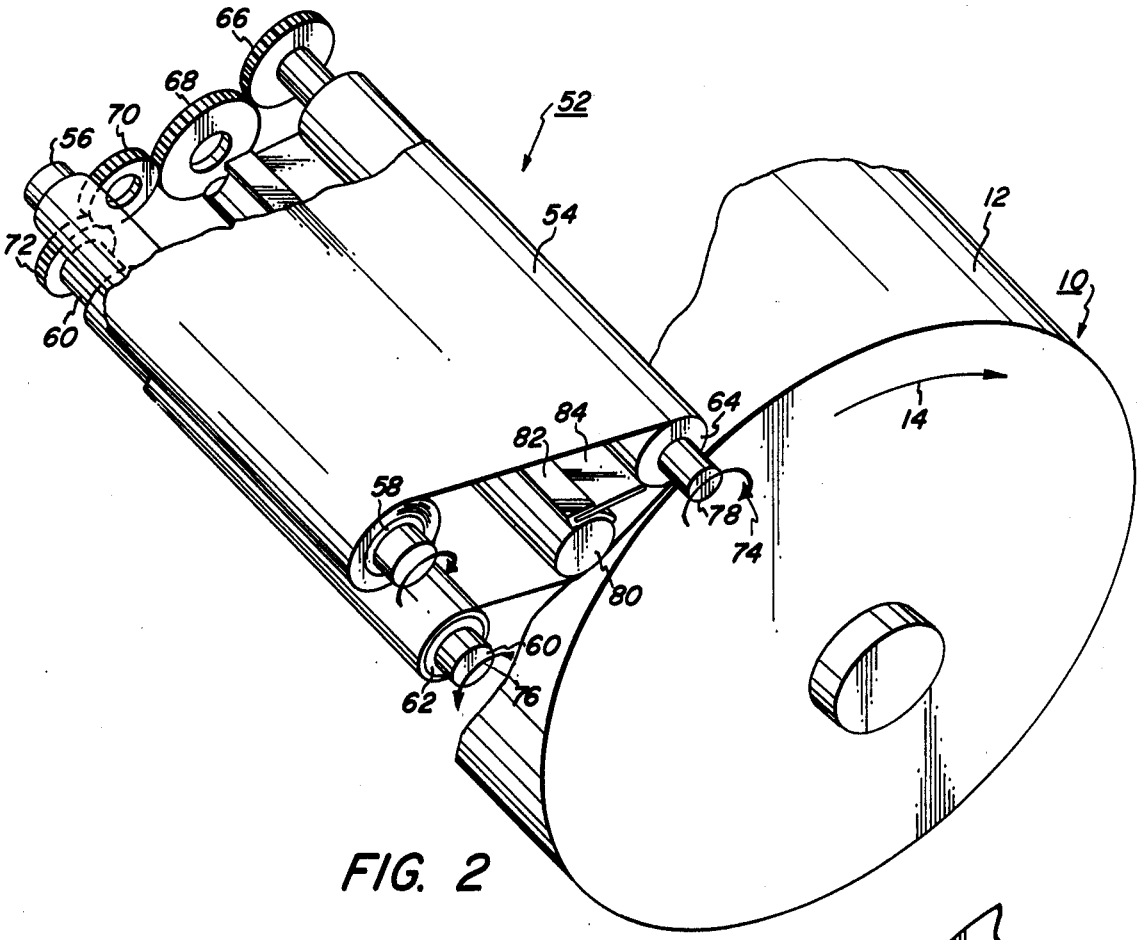
FIG. 2 illustrates the cleaning apparatus employed in the FIG. 1 printing machine.
Figure 3:
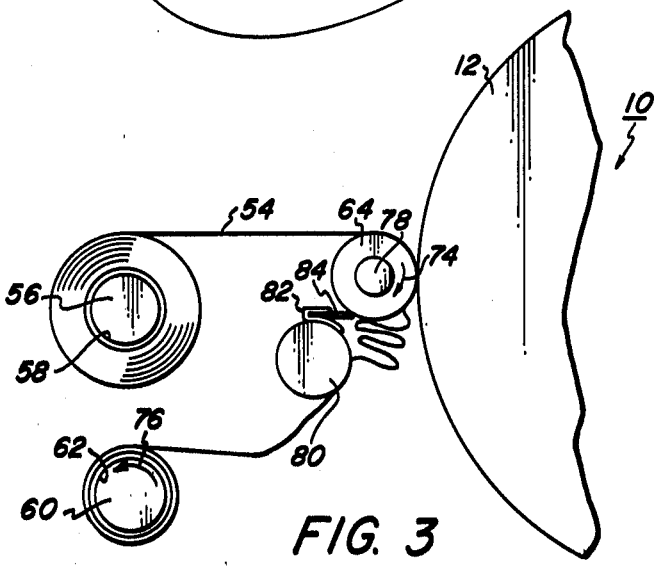
FIG. 3 shows the operation of the structure preventing entrainment of the cleaning web about the pressure roller in the FIG. 2 cleaning apparatus.

Referring now to the specific subject matter of the present invention, FIGS. 2 and 3 depict the cleaning apparatus employed in the FIG. 1 printing machine. In order to clean photoconductive surface 12, web 54 is arranged to contact a portion thereof and to be advanced intermittently so that successive portions engage photoconductive surface 12. Cleaning apparatus 52 includes a support shaft 56 having a supply spool or bobbin 58 mounted thereon serving as a supply station for the unused web. The unused portion of web 56 is wound about spool 58. A support shaft 60 has a take-up spool or bobbin 62 mounted thereon. The used or dirty portions of web 54 are wound about spool 62 which acts as a receiving station for the used web. A pressure roller 64, preferably made of rubber, presses web 54 into engagement with photoconductive surface 12. Pressure roller 64 and support shaft 60 are interlocked with one another and rotated in opposite directions by gears 66, 68, 70 and 72. A motor (now shown) drives this gear system. Pressure roller 64 rotates in the direction of arrow 74, i.e., in the same direction as drum 10, as indicated by arrow 14. In this way, the tangential velocity at contact point between web 54 and photoconductive surface 12 is in the opposite direction promoting slip therebetween and facilitating cleaning of the photoconductive surface. Shaft 60 rotates in the direction of arrow 76, i.e., in an opposed direction to that of pressure roller 64, as indicated by arrow 74. Web 54 is wound about take-up spool 62 with the surface having the residual toner particles therein being faced inwardly. Knob 78 is located at one end of pressure roller 64. Rotation of knob 78, in the direction of arrow 74, removes the slack in web 54 when it is initially positioned over pressure roller 64. This prevents the formation of wrinkles therein and insures that it is wound correctly on take-up spool 62. Guide shaft 80 presses against web 54 to ensure that it is maintained at the requisite tension. It should be noted that rotation of knob 78 rotates take-up spool 62 in the direction of arrow 76 via gears 66, 68, 70 and 72 to insure that web 54 is advanced onto spool 62 in the proper direction. Bracket 82 is secured to guide shaft 80. Blade 84 has one marginal region thereof secured to bracket 82 with the other marginal region thereof being in engagement with pressure roller 64. Blade 84 is adapted to prevent winding web 54 about pressure roller 64. Turning now to FIG. 3, the foregoing will be more clearly described.

Referring now to FIG. 3, rotation of knob 78 in the direction of arrow 74 causes take-up spool 60 to rotate in the direction of arrow 76 to advance web 54 from supply spool 58. Thus, web 54 is advanced from a supply station to a receiving station. The unused portion being retained in the supply station until intermittently advanced via the drive mechanism into contact with photoconductive surface 12 of drum 10 and then, subsequently advanced to a receiving station for storage until the entire web has been advanced from the supply station. Pressure roller 64 is mounted rotatably and driven via gear 66. Rotation of knob 78 will advance take-up spool 60 in the direction of arrow 76. Contrawise, if knob 78 is rotated in a direction opposed to arrow 74, take-up spool 62 will rotate in a direction opposed to arrow 76 producing slack in web 54, as depicted in FIG. 3. Thus, web 54 slackens and wrinkles in places. Web 54 will then wind about pressure roller 64 when the drive mechanism is actuated. Thus, on starting the printing machine, pressure roller 64 rotates in the direction of arrow 74 and support shaft 60 rotates in the direction of arrow 76, i.e., in the direction opposed to the erroneous rotation of knob 78. Therefore, cleaning web 54 wound around take-up spool 62 will unwind introducing the slackness depicted in FIG. 3. This slackness occurs at pressure roll 64. These loosened portions of web 54 cling to pressure roller 64 and attempt to rotate therewith so as to be entrained thereabout. However, blade 84 contacting pressure roller 64 prevents the slackened portion of web 54 from clinging to pressure roller 64. Thus, web 54 does not wind about pressure roller 64 and is correctly wound about take-up spool 62. Hence, the apparatus of the present invention obviates an operator error in rotating knob 78 in an erroneous direction. Preferably, blade 84 is composed of a thin metal or synthetic resin sheet with its base being fixed to guide shaft 80 by means of bracket or holder 82. The leading marginal edge portion of blade 84 contacts pressure roller 64 while the trailing marginal edge portion thereof is secured to bracket 82.

In recapitulation, it is evident that the cleaning apparatus of the present invention insures that a slackened cleaning web does not erroneously wind about a pressure roller. This prevents printing machine failure minimizing machine maintenance.

It is, therefore, evident that there has been provided in accordance with the present invention, a cleaning device which fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for cleaning contaminants from a member, including:

a flexible web;

a pressure member arranged to hold a portion of said web in engagement with the member to remove contaminants therefrom;

a supply station storing an unused supply of said web therein;

a receiving station housing a used supply of said web therein having thereon contaminants removed from the member;

means for advancing said web from said supply station to said receiving station so that successive portions of said web engage the member;

a guide shaft engaging an intermediate portion of said web to maintain a preselected tension therein;

a bracket mounted on said guide shaft; and a blade having one marginal portion thereof secured to said bracket and the other marginal portion thereof engaging said pressure member to prevent said web from being wound about said pressure member.

2. An apparatus as recited in claim 1 wherein:

said supply station includes a first spool having the unused portion of said web wound thereabout; and said receiving station includes a second spool having the used portion of said web wound thereabout.

3. An apparatus as recited in claim 2, wherein said pressure member includes a rotatably mounted roller with said web being interposed between said roller and the member.

4. An electrophotographic printing machine of the type having toner particles developing a latent image recorded on a photoconductive member with the toner powder image being transferred from the photoconductive member to a copy sheet, wherein the apparatus for cleaning untransferred toner particles from the photoconductive member includes:

a flexible web;

a pressure member arranged to hold a portion of said web in engagement with the photoconductive member to remove toner particles therefrom;

a supply station storing an unused supply of said web therein;

a receiving station housing a used supply of said web therein having thereon toner particles removed from the photoconductive member;

means for advancing said web from said supply station to said receiving station so that successive portions of said web engage the photoconductive member;

a guide shaft engaging an intermediate portion of said web to maintain a preselected tension therein;

a bracket mounted on said guide shaft; and a blade having one marginal edge portion thereof secured to said bracket and the other marginal portion thereof engaging said pressure member to prevent said web from being wound about said pressure member.

5. A printing machine as recited in claim 4, wherein:

said supply station of the cleaning apparatus includes a first spool having the unused portion of said web wound thereabout; and said receiving station of the cleaning apparatus includes a second spool having the used portion of said web wound thereabout.

6. A printing machine as recited in claim 5, wherein said pressure member of the cleaning device includes a rotatably mounted roller with said web being interposed between said roller and the photoconductive member.

* * * * *